United States Patent [19]

Davis

[11] 4,177,656

[45] Dec. 11, 1979

[54] CABINET LOCK

[75] Inventor: Edwin W. Davis, Medina, Ohio

[73] Assignee: The Eastern Company, Cleveland, Ohio

[21] Appl. No.: 882,660

[22] Filed: Mar. 2, 1978

[51] Int. Cl.[2] ..... E05B 65/44; E05C 3/02

[52] U.S. Cl. ..... 70/84; 292/216; 292/229; 292/337; 292/DIG. 37

[58] Field of Search ..... 70/78–81, 70/84, 142; 292/216, 129, 229, 337, DIG. 37, 227

[56] References Cited

U.S. PATENT DOCUMENTS

| | | | |
|---|---|---|---|
| 826,343 | 7/1906 | Mason | 292/129 |
| 3,691,799 | 9/1972 | Hoffmann et al. | 70/84 |
| 4,054,309 | 10/1977 | Borlinghaus | 292/216 |

*Primary Examiner*—Kenneth J. Dorner
*Attorney, Agent, or Firm*—Burge & Porter, Co.

[57] ABSTRACT

A cabinet lock has a one-piece housing with spaced front and back walls interconnected by an end wall and by a pair of spaced side walls. The housing has a first set of aligned holes formed through the front and back walls, and a second set of aligned holes formed through the side walls. A lock actuator mechanism is journaled by the first set of holes and includes an actuator movable between locked and unlocked positions. A rotary latch bolt mechanism is journaled by the second set of holes and includes a latch bolt movable between latched and unlatched positions. The lock actuator mechanism includes a first spring which biases an actuator toward its locked position. The latch bolt mechanism includes a second spring which biases the latch bolt toward its unlatched position. The lock actuator mechanism includes a cam with is interengageable with the latch bolt to retain the latch bolt in its latched position until the lock actuator is moved to its unlocked position. A feature of the cabinet lock is its highly versatile housing which may be used with a wide variety of lock actuator and latch bolt mechanisms to provide a series of heavy duty cabinet locks suitable for many different applications.

30 Claims, 26 Drawing Figures

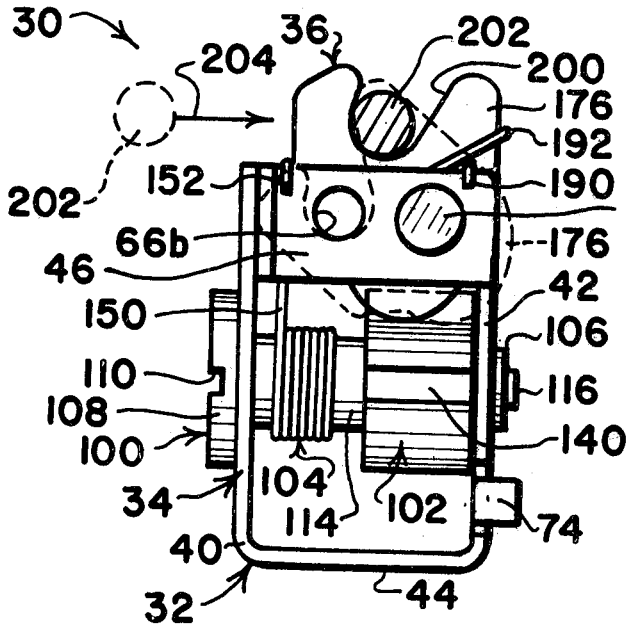

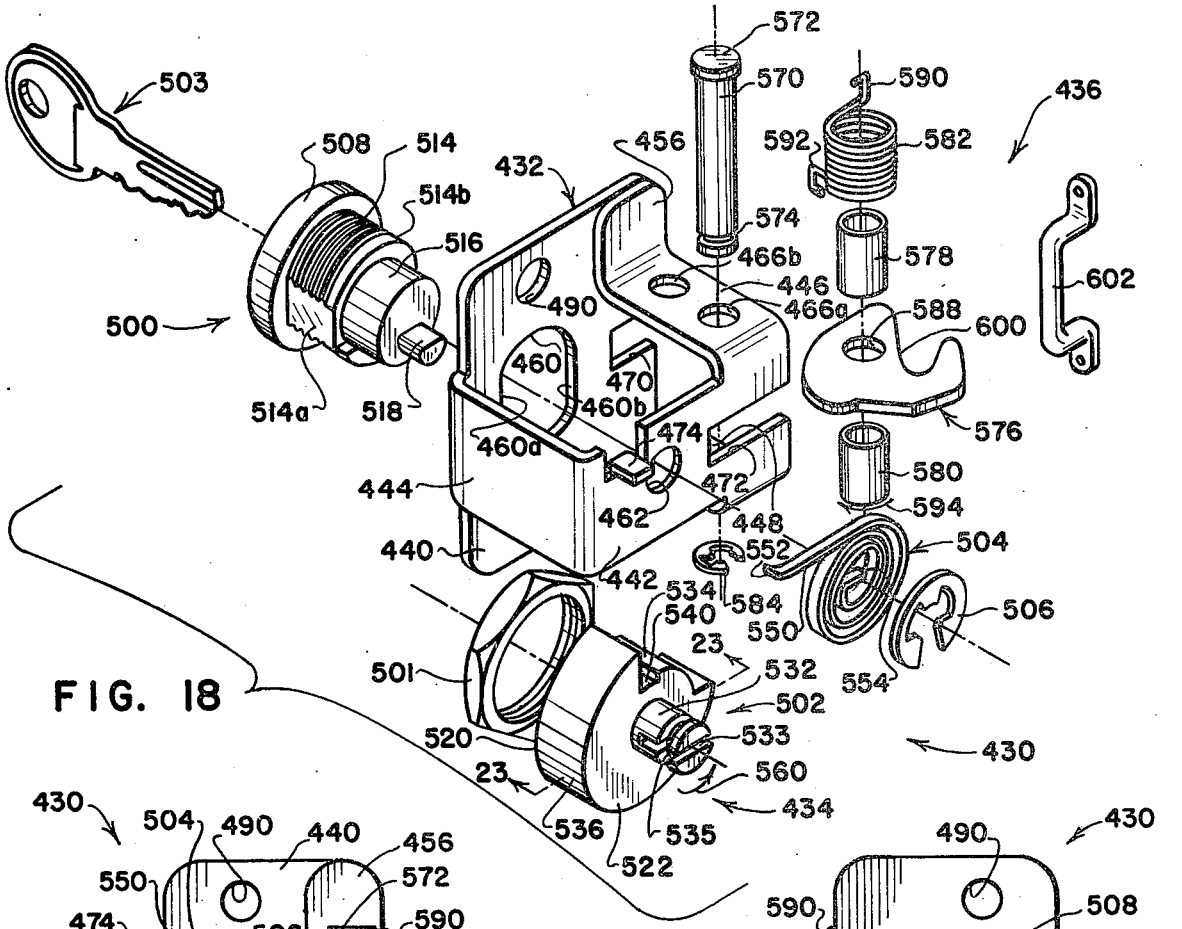
FIG. 18
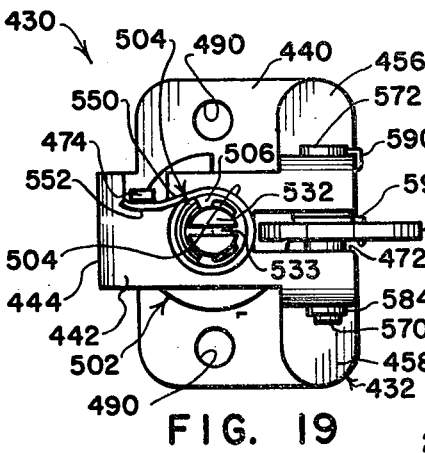
FIG. 19
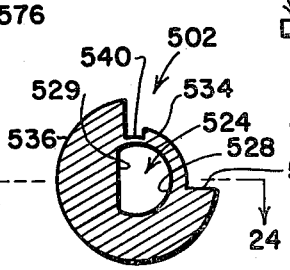
FIG. 23
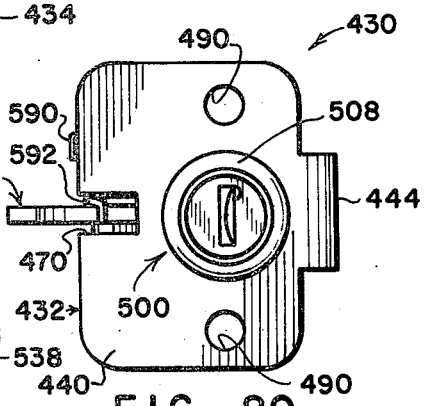
FIG. 20
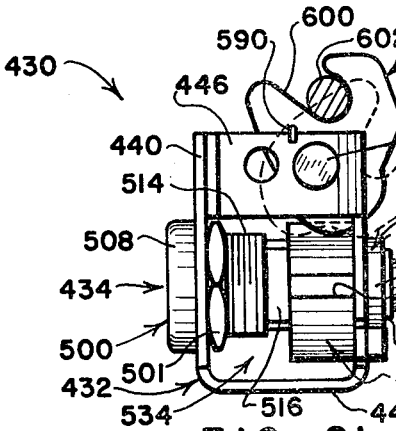
FIG. 21
FIG. 24
FIG. 22

CABINET LOCK

BACKGROUND OF THE INVENTION

1. Field of the Invention

The present invention relates generally to cabinet locks and, more particularly, to a novel and improved cabinet lock which utilizes a highly versatile housing capable of receiving a wide variety of lock actuator and latch bolt mechanisms. 2. Prior Art While proposals have been made to provide many different types of cabinet locks, most of these proposals have been directed to locks intended for use in particular applications. As a result, most proposed lock constructions utilize specially configured parts having very little, if any, interchangeability. A particularly significant drawback of many lock proposals is that the specially configured housings they utilize to position and support their relatively movable operating components have not been adaptable for use with a wide variety of lock actuator and latch bolt mechanisms. Instead, substantially each new lock application has been served by a lock having a different type of housing than is utilized in other applications. Since the cost of forming a rugged, durable lock housing of suitable configuration is one of the major expenses incurred in fabricating a cabinet lock, the non-standardization of lock housings and the attendant high tooling costs incurred in providing a host of different, totally non-interchangeable lock housings has greatly increased the cost of cabinet locks.

SUMMARY OF THE INVENTION

The present invention overcomes the foregoing and other drawbacks of prior proposals by providing novel and improved cabinet locks having many parts which are interchangeable for use in a wide variety of lock applications, particularly including a lock housing which is usable with several different types of lock actuator and latch bolt mechanisms.

A cabinet lock embodying the preferred practice of the present invention includes a one-piece housing having front and back walls extending in spaced, substantially parallel planes. The front and back walls have overlying first and second ends and are interconnected near their first ends by an end wall, and near their second ends by a pair of side walls. The side walls extend in spaced parallel planes which substantially orthogonally intersect the planes of the front and back walls. The front and back walls have a first set of aligned holes formed therethrough. The side walls have a second set of aligned holes formed therethrough.

A lock actuator mechanism is journaled by the first set of holes. A latch bolt mechanism is journaled by the second set of holes. The lock actuator mechanism includes a cam member, which is movable between locked and unlocked positions, and a first biasing device for biasing the cam member toward its locked position. The latch bolt mechanism includes a latch bolt member, which is mounted for rotary movement between latched and unlatched positions, and a second biasing device for biasing the latch bolt member toward its unlatched position. The cam member and the latch bolt member have interengaging surfaces formed thereon (1) for permitting the cam member to move, under the influence of the first biasing device to its locked position when the latch bolt member is moved, in opposition to the action of the second biasing device, from its unlatched position to its latched position, and (2) for retaining the latch bolt member in its latched position until the cam member is moved, in opposition to the action of the first biasing means, to its unlocked position.

The versatile housing used with locks embodying the preferred practice of the present invention provides a rigid, sturdy structure which securely supports a lock actuator mechanism at two locations in spaced but rigidly interconnected front and back walls, and which securely supports a latch bolt mechanism at two locations in spaced but rigidly interconnected side walls. The resulting arrangement provides a rugged, heavy duty cabinet lock which can be fabricated at minimal expense. The housing, itself, is preferably formed as a stamping, utilizing simple blanking, piercing, forming and spot welding procedures.

Lock actuator members of the rotary type and of the axially-movable push-pull type are usable with the versatile housing. Even key-operated lock cylinders can be used as actuators. Lock actuator cams of the rotary type and of the axially movable type are likewise useable with the housing. Moreover, latch bolt mechanisms configured to receive keepers which move relatively toward the lock housing from any of a wide variety of relative directions can be accommodated by the housing, and these various latch bolt mechanisms can be used, substantially interchangeably, with any of a host of different lock actuator members and lock actuator cams.

As will be apparent from the foregoing summary, it is a general object of the present invention to provide a novel and improved cabinet lock.

It is a further object to provide a novel and improved cabinet lock having a housing which may be used with a wide variety of lock actuator mechanisms and a wide variety of latch bolt mechanisms, thereby permitting the lock to be employed in many different applications.

It is a further object to provide a cabinet lock of the type described utilizing relatively simple lock actuator and latch bolt mechanisms each including a separate biasing element, one of the biasing elements being operative to bias a movable lock actuator toward its locked position and the other being operative to bias a rotary latch bolt toward its unlatched position, the actuator mechanism including a cam which is interengageable with the latch bolt to retain the latch bolt in its latched position until the actuator is moved to its unlocked position.

These and other objects and a fuller understanding of the invention described and claimed in the present application may be had by referring to the following description and claims taken in conjunction with the accompanying drawings.

BRIEF DESCRIPTION OF THE DRAWINGS

FIG. 18 is an exploded perspective view of another lock embodiment incorporating principles of the present invention;

FIGS. 19 and 20 are rear and front elevational views of the lock of FIG. 18;

FIG. 21 is a top plan view of the lock of FIG. 18;

FIG. 22 is a side elevational view of the lock of FIG. 18;

FIG. 23 is a sectional view of an actuator mechanism cam used in the lock of FIG. 18, as seen substantially from a plane indicated by a line 23—23 in FIG. 18;

FIG. 24 is a sectional view of the actuator cam as seen from a plane indicated by a line 24—24 in FIG. 23; and, FIGS. 25 and 26 are top plan views of alternate embodiments of the lock of FIG. 18.

DESCRIPTION OF THE PREFERRED EMBODIMENTS

Figure 1:
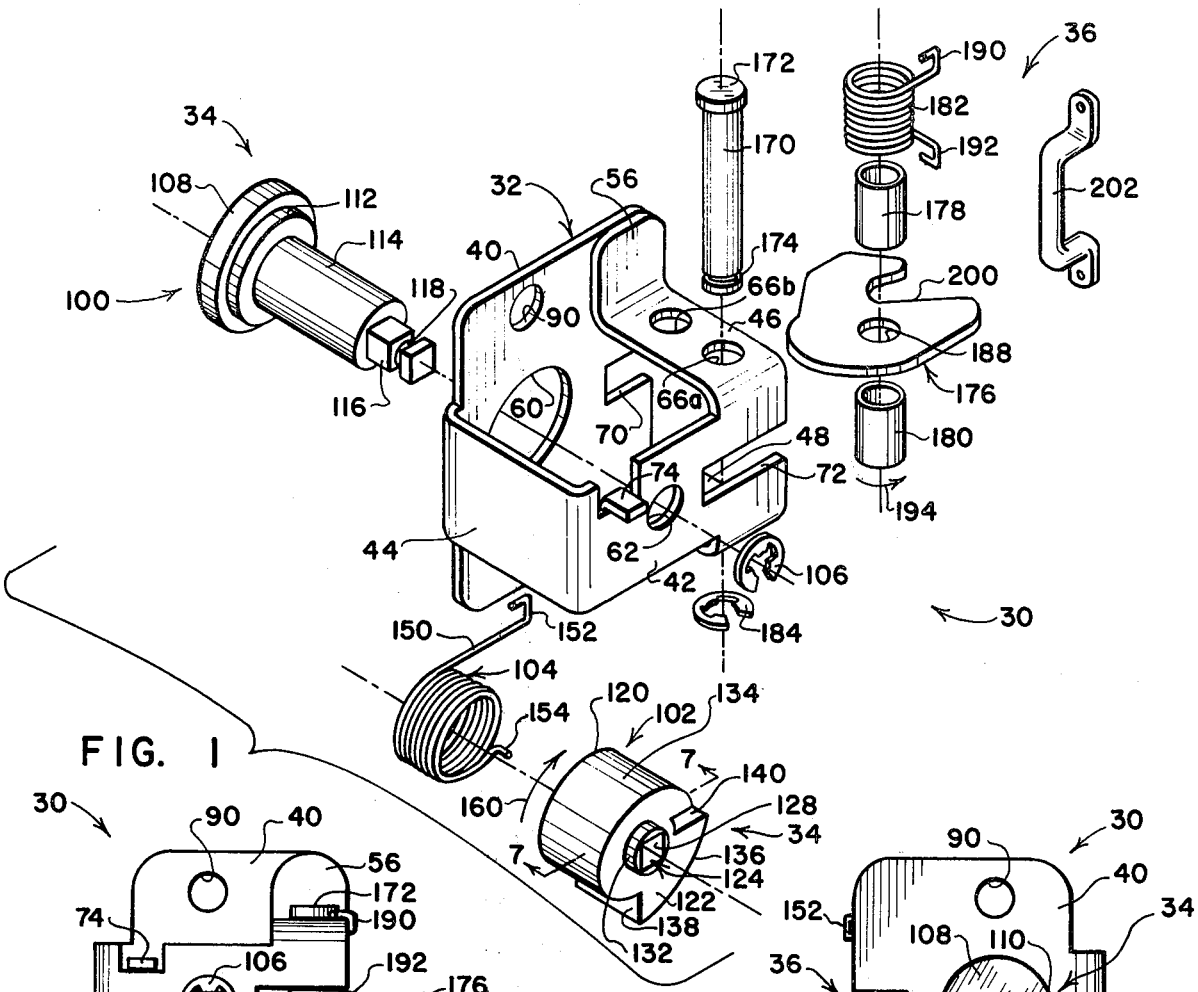
FIG. 1 is an exploded perspective view of one lock embodiment incorporating principles of the present invention.
Figure 3:
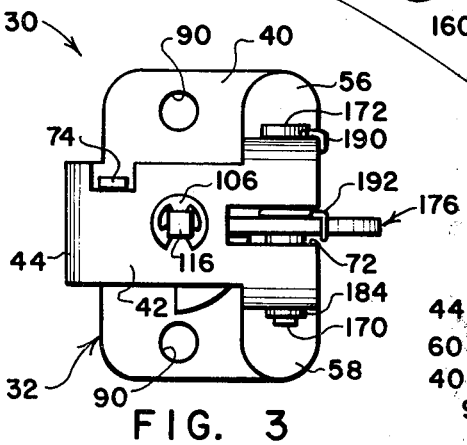
FIGS. 3 and 4 are rear and front elevational views of the lock of FIG. 2.
Figure 2:
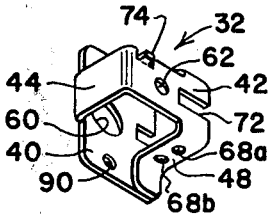
FIG. 2 is a perspective view on a reduced scale showing details of construction of lower portions of a housing utilized in the lock of FIG. 1.
Figure 4:
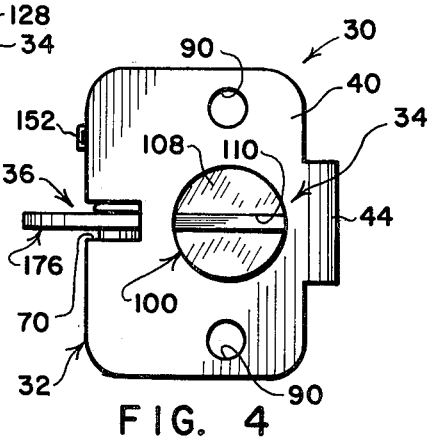

Referring to FIG. 1, a first lock embodiment incorporating principles of the present invention is indicated generally by the numeral 30. The lock 30 includes a housing indicated generally by the numeral 32, an actuator mechanism indicated generally by the numeral 34, and a latch bolt mechanism indicated generally by the numeral 36.

Referring to FIGS. 1-6, the housing 32 is formed of one-piece construction, preferably as a stamping, fabricated by blanking, piercing, forming and spot-welding operatings. The housing 32 has front and back walls 40, 42 which extend in spaced, parallel planes. The front and back walls 40, 42 overlie each other and are interconnected near one of their ends by an end wall 44 and near the other of their ends by a pair of spaced side walls 46, 48. The end wall 44 is formed integrally with the front and back walls 40, 42 and extends in a plane which orthogonally intersects the planes of the front and back walls 40, 42. The side walls 46, 48 are formed integrally with the back wall 42 and extend in spaced, parallel planes which orthogonally intersect the planes of the front, back and end walls 40, 42, 44. The side walls 46, 48 have feet 56, 58 which engage and are spot welded to the back face of the front wall 40.

A first set of aligned holes 60, 62 are formed through the front and back walls 40, 42. Two sets of aligned holes 66*a*, 68*a* and 66*b*, 68*b* are formed through the side walls 46, 48. Coplanar, elongate slots 70, 72 are formed through the front and back walls 40, 42 at locations centered between the side walls 46, 48. The plane of the slots 70, 72 parallels the planes of the side walls 46, 48. Other formations provided on the housing 32 include a rearwardly-turned tab 74 formed on the back wall 42, and a pair of mounting holes 90 provided through the front wall 40.

The actuator mechanism 34 includes a lock actuator member 100, a cam 102, a spring 104, and a retainer clip 106. The actuator member 100 has an enlarged diameter head 108 on its forward end. The head 108 is provided, on its front face, with a screwdriver slot 110, and, on its back face, with a reduced diameter shoulder 112 configured to be journaled by the front wall hole 60. The actuator member 100 has a cylindrical stem portion 114 and a rearward end region 116 of substantially square cross-section. A groove 118 is formed in the rearward end region 116 to receive the retainer clip 106.

Figure 7:
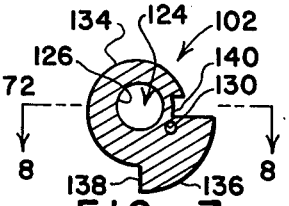
FIG. 7 is a sectional view of an actuator mechanism cam, used in the lock of FIG. 1, as seen from a plane indicated by a line 7—7 in FIG. 1.
Figure 8:
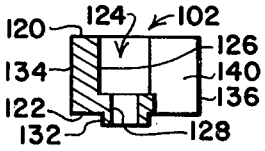
FIG. 8 is a sectional view of the actuator cam as seen from a plane indicated by a line 8—8 in FIG. 7.
Figure 6:
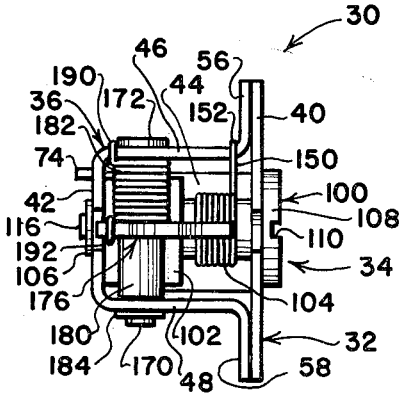
FIG. 6 is a side elevational view of the lock of FIG. 1.

Referring to FIGS. 7 and 8 in conjunction with FIG. 1, the cam 102 has front and back faces 120, 122. A central bore 124 extends through the cam 102 and opens through the faces 120, 122. The bore 120 has a forward portion 126 configured to receive cylindrical stem 114 of the actuator member 100, and a rearward bore portion 128 configured to drivingly engage the square rearward end region 116 of the actuator member 100. A hole 130, best seen in FIG. 7, is formed in the cam 102 and opens through the front face 120. A cylindrical shoulder 132 is provided on the back face 122 of the cam 102 and is configured to be journaled in the back wall hole 62. The actuator member 100 extends through the front wall hole 60, through the cam bore portions 126, 128, through the back wall hole 62, and is secured in place by the retainer clip 106, thereby mounting the cam 102 for rotation with the actuator member 100.

The cam 102 has two curved outer surface portions 134, 136. A radially extending shoulder 138 and a radially extending slot formation 140 are provided at the junctures of the curved surface portions 134, 136. The curved outer surface portion 134 increases progressively in radius as it extends from the slot formation 140 to the shoulder 138. The curved outer wall portion 136 is of substantially constant radius.

The spring 104 is torsion coil spring having an elongate forward end portion 150 terminating in a hook 152. The hook 152 wraps around the side wall 46 to secure the forward end portion 150 of the spring 104 to the housing 32. The rearward end of the spring 104 has an axially projecting tab 154 which extends into the hole 130 formed in the cam 102. The spring 104 is operative to bias the cam 102 in a direction indicated by an arrow 160 in FIG. 1. If desired, the hole 130 can be eliminated and the spring tab 154 can be inserted into the radially extending slot 140.

The latch bolt mechanism 36 includes a mounting pin 170 having an enlarged diameter head 172 at one end and a circumferentially extending groove 174 formed near the other end. The latch bolt mechanism 36 additionally includes a latch bolt member 176, a pair of bushings 178, 180, a spring 182, and a retainer clip 184. The mounting pin 170 is configured to be journaled in either of the sets of aligned holes 66*a*, 68*a* or 66*b*, 68*b*. In the lock embodiment 30, the mounting pin 170 is positioned in the holes 66*a*, 68*a* and is retained in place by the retainer clip 184. If desired, the groove 174 and the retainer clip 184 can be eliminated, and the lower end of the pin 170 crimped to retain it in place.

The latch bolt member 176 is formed from a sheet of metal and is provided with a central mounting hole 188. The latch bolt member 176 is journaled on the mounting pin 170 with the bushings 178, 180 extending on opposite sides thereof to position the latch bolt member 176 in the plane of the back wall slot 72. A single bushing, not shown, having a length slightly greater than the combined lengths of the bushings 178, 180, can be pressed into the hole 188 in substitution for the bushings 178, 180.

The spring 182 is torsion coil spring having hook formations 190, 192 at its opposite ends. The hook formation 190 engages the side wall 46, while the hook formation 192 is reeved around the rearward edge of the bolt member 176. The torsion coil spring 182 is operative to bias the bolt member 176 in a direction indicated by an arrow 194 in FIG. 1.

Figure 5:
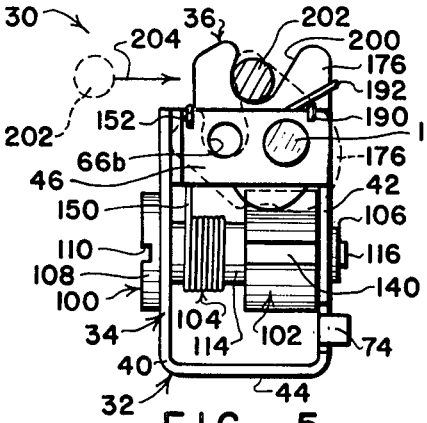
FIG. 5 is a top plan view of the lock of FIG. 1.

The latch bolt member 176 is provided with a U-shaped operating surface 200 which is configured to receive a conventional keeper having a circular cross section, as indicated generally by the numeral 202. In normal operation, the lock 30 is mounted on the door frame of a cabinet, not shown, and the keeper 202 is positioned on the door where it will be engaged by the operating surface 200 of the latch bolt member 176 as the door is closed. Referring to FIG. 5, the latch bolt member 176 is movable between an unlatched position, indicated in phantom, wherein the operating surface 200 is positioned to receive the keeper 202 as the keeper 202 moves relatively toward the lock 30, as indicated by an arrow 204. As the keeper 202 engages the operating surface 200, it causes the latch bolt member 176 to rotate, in opposition to the action of the spring 182, to the latched position shown in solid lines in FIG. 5. As the latch withdraws from engagement with the radially extending slot 140 formed in the cam member 102, and permits the torsion coil spring 104 to rotate the cam member 102 to a locked position wherein the latch bolt member 176 engages the curved cam surface 134. When the latch bolt member 176 is engaging the curved cam surface 134, it is prevented from rotating back to its unlatched position. Moreover, while the latch bolt member 176 is engaged by the curved cam surface 134, and, by virtue of the increasing radius of the curved cam surface 134, the action of the torsion coil spring 104 in biasing the cam member 102 in the direction of the arrow 160 causes the latch bolt member 176 to be urged in a rotational direction opposite that indicated by the arrow 194, whereby the latch bolt member 176 tends to more tightly engage the keeper 202.

The lock 30 is unlocked by rotating the actuator member 100 in a direction opposite that of the arrow 160 to an unlocked position where the slot 140 aligns with the latch bolt member 176, permitting the latch bolt member 176 to rotate, under the influence of the spring 182, to its unlatched position whereupon portions of the latch bolt member 176 are caused to extend into the slot 140. When the latch bolt member 176 is in its unlatched position, its extension into the cam slot 140 prevents the cam member 102 and its drivingly interconnected actuator member 100 from being rotated out of the unlocked position. This prevents damage to the cabinet lock 30 which might otherwise occur if the cabinet door were slammed after the latch bolt member 176 had been moved to its latched position by rotating the actuator member 100 while the cabinet door was open.

Figure 9:
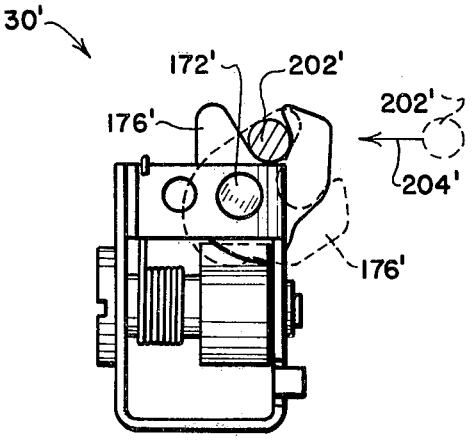
FIGS. 9 and 10 are top plan views of two alternate embodiments of the lock of FIG. 1.
Figure 10:
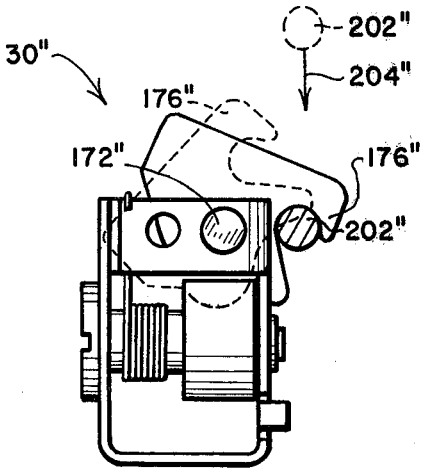

Referring to FIGS. 9 and 10, it will be readily apparent to those skilled in the art that modifications can be made in the arrangement and configuration of the latch bolt member 176 to provide alternate locking embodiments 30', 30'' adapted to receive keepers 202', 202'' which move relatively toward the lock embodiments 30', 30'' from directions different than that illustrated in FIG. 5, as indicated by the arrows 204', 204''. In the lock embodiment of FIG. 9, the latch bolt member 176' is arranged to receive a keeper 202' which moves relatively toward the lock 30' from the right as indicated by the arrow 204'. In the lock embodiment of FIG. 10, the latch bolt member 176'' is arranged to receive a keeper 202'' which moves relatively toward the lock 30'' from above, as indicated by the arrow 204''.

Figure 11:
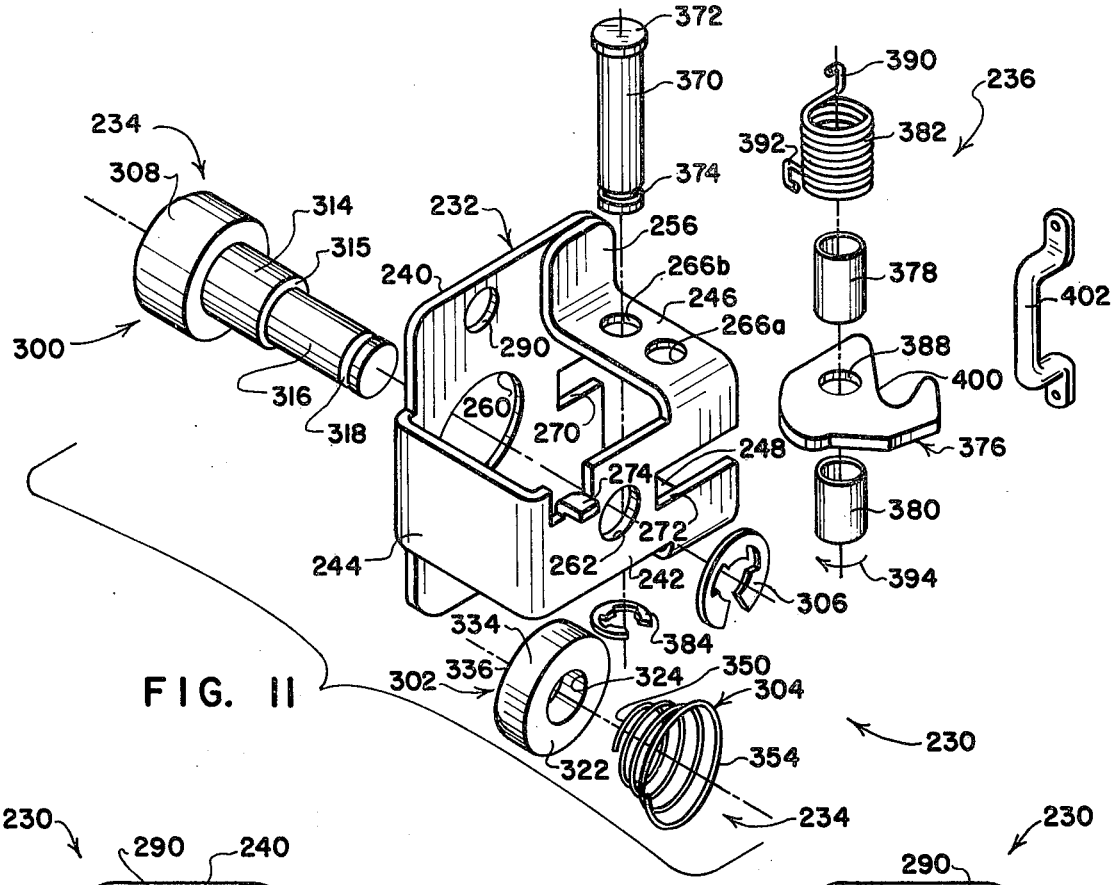
FIG. 11 is an exploded perspective view of another lock embodiment incorporating principles of the present invention.
Figure 12:
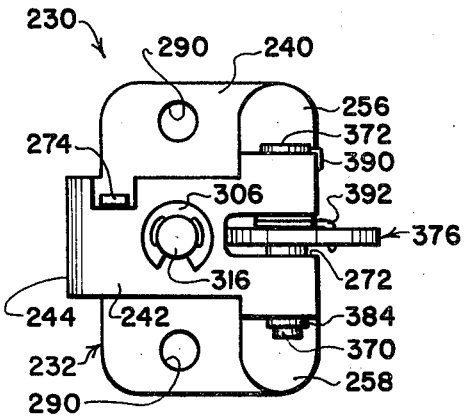
FIGS. 12 and 13 are rear and front elevational views of the lock of FIG. 11.
Figure 13:
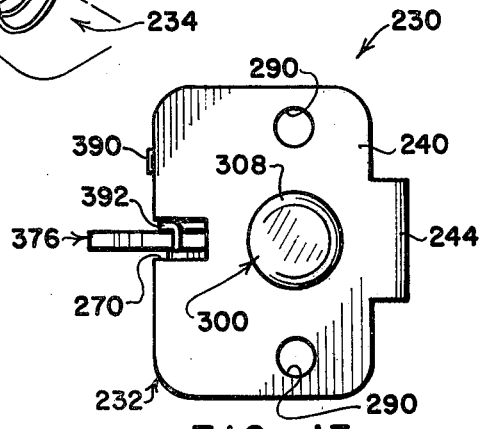

Referring to FIG. 11, another lock embodiment is indicated generally by the numeral 230. The lock 230 includes a housing indicated generally by the numeral 232, an actuator mechanism indicated generally by the numeral 234, and a latch bolt mechanism indicated generally by the numeral 236.

The housing 232 is identical to the housing 32 and its formations are indicated by the same numerals used in describing the housing 32 with the addition of the number two hundred thereto.

The actuator mechanism 234 includes a lock actuator member 300, a cam 302, a spring 304 and a retainer clip 306. The actuator member 300 has an enlarged diameter, push-button head 308 on its forward end. The head 308 is configured to slip fit in the front wall hole 260. The actuator member 300 has cylindrical stem portion 314 and a rearward end portion 316 of reduced diameter. An annular shoulder 315 is provided between the portions 314, 316. A groove 318 is formed in the rearward end region 316 to receive the retainer clip 306.

Referring to FIGS. 12–15 in conjunction with FIG. 11, the cam 302 has front and back faces 320, 322. A central bore 324 extends through the cam 302 and opens through the faces 320, 322. The bore 324 has a diameter configured to receive the cylindrical end portion 316 of the actuator member 300 in a slip fit. The actuator member 300 extends through the front wall hole 260, through the cam bore 324, through the back wall hole 262, and is secured in place by the retainer clip 306, thereby mounting the cam 302 for axial movement on and/or with the actuator member 300. The cam 302 has a substantially cylindrical outer surface portion 334 with a rounded forward edge 336.

Figure 14:
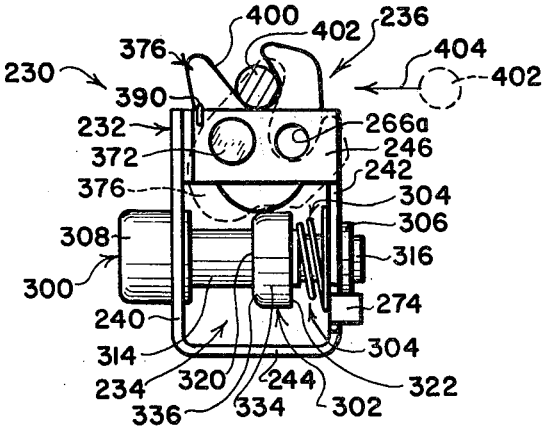
FIG. 14 is a top plan view of the lock of FIG. 11.
Figure 15:
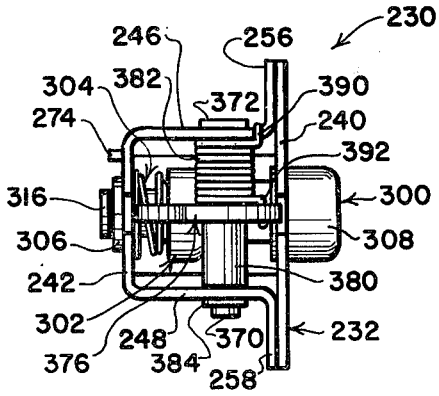
FIG. 15 is a side elevational view of the lock of FIG. 11.

The spring 304 is a compression coil spring having a forward end portion 350 and a rearward end portion 354. The forward end portion 350 engages the back face 322 of the cam 302 while the rearward end 354 engages the forward face of the back wall 242, as best seen in FIG. 14. The spring 304 is operative to bias the forward face 320 of the cam 302 into engagement with the actuator member shoulder 315 and to bias the cam 302 together with the actuator member 300 in a forward direction, whereby the enlarged diameter, push-button end 308 of the actuator member 300 is normally caused to project a substantial distance forwardly from the front wall 240. When the cam 302 and the actuator member 300 are in the position shown in FIG. 14, they are in what is termed their locked position. The enlarged end 308 of the actuator 300 is utilized as a push button to move the cam 302 rearwardly to an unlocked position in opposition to the action of the compression coil spring 304.

The latch bolt mechanism 236 includes a mounting pin 370 having an enlarged diameter head 372 at one end and a circumferentially extending groove 374 formed near the other end. The latch bolt mechanism 236 additionally includes a latch bolt member 376, a pair of bushings 378, 380, a spring 382, and a retainer clip 384. The mounting pin 370 is configured to be journaled in either of two sets of aligned holes, upper ones of which are indicated by numerals *266a, 266b*. In the lock embodiment 230, the mounting pin 370 is positioned in the hole 266b and in an aligned lower mounting hole (not shown), and is retained in place by the retainer clip 384.

The latch bolt member 376 is formed from a sheet of metal and is provided with a central mounting hole 388. The latch bolt member 376 is journaled on the mounting pin 370 with bushings 378, 380 extending on opposite sides thereof to position the latch bolt member 376 in the plane of the back wall slot 272.

The spring 382 is a torsion coil spring having hook formations 390, 392 at its opposite ends. The hook formation 390 engages the side wall 246, while the hook formation 392 is reeved around the forward edge of the bolt member 376. The torsion coil spring 382 is operative to bias the bolt member 376 in a direction indicated by an arrow 394 in FIG. 11.

The latch bolt member 376 is provided with a U-shaped operating surface 400 which is configured to receive a conventional keeper having a circular cross section, as indicated generally by the numeral 402. In normal operation, the lock 230 is mounted on the door of a cabinet, not shown, and the keeper 402 is positioned on a door frame or on other cabinet structure at a location where it will be engaged by the operating surface 400 of the latch bolt member 376 as the door is closed. Referring to FIG. 14, the latch bolt member 376 is movable between an unlatched position, indicated in phantom, wherein the operating surface 400 is positioned to receive the keeper 402 as the keeper 402 moves relatively toward the lock 230, from the right, as indicated by an arrow 404. As the keeper 402 engages the operating surface 400, it causes the latch bolt member 376 to rotate, in opposition to the action of the spring 382, to the latched position shown in solid lines in FIG. 14. As the latch bolt member 376 moves from its unlatched position to its latched position, its engagement with the curved forward surface portion 336 of the cam 302 causes the cam 302 to slide momentarily rearwardly along the cylindrical body 316 of the actuator member 300 so that the latch bolt member 376 may assume its latched position, shown in solid lines in FIG. 14, whereafter the cam member 302 reassumes the position shown in FIG. 14. Once the cam member 302 reassumes the position shown in FIG. 14, its cylindrical side surface 334 engages the latch bolt member 376 preventing the latch bolt member 376 from rotating back to its unlatched position.

The lock 230 is unlocked by depressing the push button end 308 of the actuator 300 to move the cam member 302, in opposition to the action of the spring 304, to a position where the latch bolt member 376 can, under the influence of spring 382, return to its unlatched position.

Figure 16:
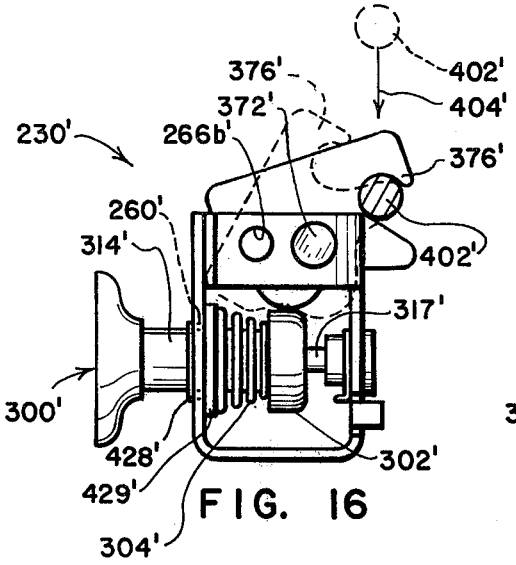
FIGS. 16 and 17 are top plan views of alternate embodiments of the lock of FIG. 11.
Figure 17:
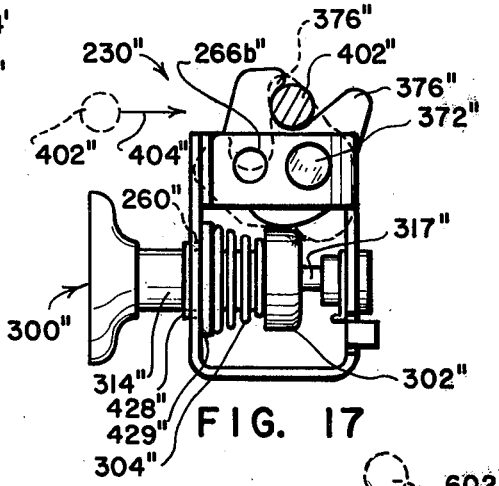

Referring to FIGS. 16 and 17, it will be readily apparent to those skilled in the art that modifications can be made in the arrangement and configuration of the latch bolt member 376 and in the mounting of the cam member 302 to provide alternate locking embodiments 230', 230'' adapted to receive keepers 402', 402'' which move relatively toward the lock embodiments 230', 230'' from directions different than that illustrated in FIG. 14, as indicated by arrows 404', 404''. In the lock embodiment of FIG. 16, the latch bolt member 376' is arranged to receive a keeper 402' which moves relatively toward the lock 230' from above, as indicated by the arrow 404'. In the lock embodiment of FIG. 17, the latch bolt member 376'' is arranged to receive a keeper 402'' which moves relatively toward the lock 230'' from the left, as indicated by the arrow 404''.

Whereas the lock embodiment of FIG. 11 utilizes a push button actuator 300 to effect movement of its cam 302, the embodiments of FIGS. 16 and 17 use pull-operated knobs 300', 300'' to move their cams 302', 302'' forwardly, or leftwardly as viewed in FIGS. 16 and 17, to unlock the locks 230', 230''. The lock embodiments of FIGS. 16 and 17 also differ from the lock embodiment of FIG. 14 in the mounting location of the latch bolt members 376', 376''. In the embodiments of FIGS. 16 and 17, the rearward set of side wall holes is utilized for the mounting pins 370', 370'' rather than the forward set of holes *266b'*, *268b'* and *266b''*, *268b''*. The lock embodiments of FIGS. 16 and 17 also differ from the embodiment of FIG. 14 in their provision of back-wall-mounted guide shafts 317', 317'' to stabilize and movably support the actuators 300', 300''. The lock embodiments of FIGS. 16 and 17 further differ in their provision of bushings 428', 428'' to reduce the diameter of the housing holes 260', 260'' to accommodate smaller diameter actuator stems 314', 314''. The left ends of the springs 304', 304'' engage radially extending flanges 429', 429'' formed on the bushings 428', 428'' to hold the bushings 428', 428'' in place. Alternatively, the housing holes 260', 260'' can be formed smaller than the hole 260 to receive the actuator stems 314', 314'' in a slip-fit.

Referring to FIG. 18, still another lock embodiment is indicated generally by the numeral 430. The lock 430 includes a housing indicated generally by the numeral 432, an actuator mechanism indicated generally by the numeral 434, and a latch bolt mechanism indicated generally by the numeral 436. The housing 432 is identical to the housings 232 and 32 with the exception that its front wall hole 460 is enlarged somewhat and is provided with flats *460a, 460b* on opposite sides thereof to receive, as will be explained in greater detail, corresponding flats formed on the threaded mounting portion of a conventional key-operated lock cylinder, indicated generally by the numeral 500. Since the housing 432 is identical to the housing 32, its formations are indicated by the same numerals used in describing the housing 32 with the addition of the number four hundred thereto.

The actuator mechanism 434 includes the conventional lock cylinder 500, a cam 502, a spring 504 and a retainer clip 506. The lock cylinder 500 is preferably of the type sold by Eaton, Yale and Towne under the model designation 9920X2, and has an enlarged diameter head 508 on its forward end. The head 508 is configured to fit snugly against the forward face of the front wall 440. The lock cylinder 500 has threaded stem portion 514 with flats *514a, 514b* formed on opposite sides thereof for matingly engaging the flats *460a, 460b* provided in the front wall hole 460. The lock cylinder 500 has a cylindrical stem portion 516 and a substantially semicylindrical operating portion 518 projecting rearwardly from the cylindrical portion 516 at a location below the central axis of the cylindrical portion 516. The lock cylinder 500 is adapted to receive a key 503 which, when inserted into the cylinder 500, may be rotated to rotate the operating portion 518 180 degrees between the "down" position shown in FIG. 18 and an "up" position, not shown. A threaded fastener 501 is tightened onto the threaded portion 514 of the lock cylinder 500 to retain the lock cylinder 500 in place on the front wall 440 of the housing 432. Alternatively, a conventional spring retainer clip, not shown, may be used in place of the nut 501.

Referring to FIGS. 23 and 24 in conjunction with FIG. 18, the cam 502 has front and back faces 520, 522. A central bore 524 extends into the cam 502 and opens through the front face 520. The bore 524 has a forward portion 526 of cylindrical configuration adapted to receive the cylindrical portion 516 of the lock cylinder 500, and a rearward bore portion 528 provided with a flat surface 529 therein. The flat surface 529 is configured to cooperate with the operating portion 518 of the lock cylinder 500 to establish a lost-motion driving connection between the lock cylinder 500 and the cam 502. A cylindrical projection 532 is provided on the back face 522 of the cam 502 and is configured to be journaled in the back wall hole 462. A diametrically extending slot 533 is provided in the projecting portion 532 and a circumferentially extending groove 535 is provided near the rearward end of the cylindrical portion 532. The retainer clip 506 is adapted to be received in the groove 535.

The cam 502 has two curved outer surface portions 534, 536. A radially extending shoulder 538 and a radially extending slot 540 are provided at the junctures of the curved surface portions 534, 536. The curved outer surface portion 534 has a constant first radius. The curved outer wall portion 536 has a constant second radius larger than the first radius.

The spring 504 is a helically wound torsion spring having an elongate outer end portion 550 terminating in a slightly hook-shaped tab 552. The hook-shaped tab 552 extends into engagement with the back wall tab 474 to secure the outer end portion 550 of the spring 504 to the housing 432, as best seen in FIG. 19. The inner end of the spring 504 has a radially projecting tab 554 which extends into the cam member slot 533. The spring 504 is operative to bias the cam 502 in a direction indicated by an arrow 560 in FIG. 18.

The latch bolt mechanism 436 is identical in all respects to the latch bolt mechanism 36 and operates, in conjunction with the cam 502, in exactly the same manner as the latch bolt mechanism 36 operates in conjunction with cam 102.

The latch bolt member 576 is provided with a U-shaped operating surface 600 which is configured to receive a conventional keeper having a circular cross section, as indicated generally by the numeral 602. In normal operation, the lock 430 is mounted on the door of a cabinet, not shown, and the keeper 602 is positioned on a door frame or other cabinet structure at a location where it will be engaged by the operating surface 600 of the latch bolt member 576 as the door is closed. Referring to FIG. 21, the latch bolt member 576 is movable between an unlatched position, indicated in phantom, wherein the operating surface 600 is positioned to receive the keeper 602 as the keeper 602 moves relatively toward the lock 430, from the right as indicated by an arrow 604. As the keeper 602 engages the operating surface 600, it causes the latch bolt member 576 to rotate, in opposition to the action of the spring 582, to the latched position shown in solid lines in FIG. 21. As the latch bolt member 576 moves from its unlatched position to its latched position, it withdraws from engagement with the radially extending slot 540 formed in the cam member 502, and permits the torsion coil spring 504 to rotate the cam member 502 to a locked position wherein the latch bolt member 576 engages the curved cam surface 534. When the latch bolt member 576 is engaging the curved cam surface 534, it is prevented from rotating back to its unlatched position.

The lock 430 is unlocked by inserting the key 503 into the lock cylinder 500 and rotating it in a direction which will cause the operating portion 518 to engage the cam member flat 529 and rotate the cam member 502, in opposition to the action of the spring 504, to its unlocked position where the cam slot 540 aligns with the latch bolt member 576 and permits the latch bolt member 576 to rotate, under the influence of the spring 582, to its unlatched position. When the latch bolt member 576 is in its unlatched position, its extension into cam member slot 540 prevents the cam member 502 from being rotated out of its unlocked position. This prevents damage to the cabinet lock 430 which might otherwise occur if the cabinet door were slammed after the latch bolt 576 had been moved to its latched position by operating the actuator member 500 while the cabinet door was open.

Figure 25:
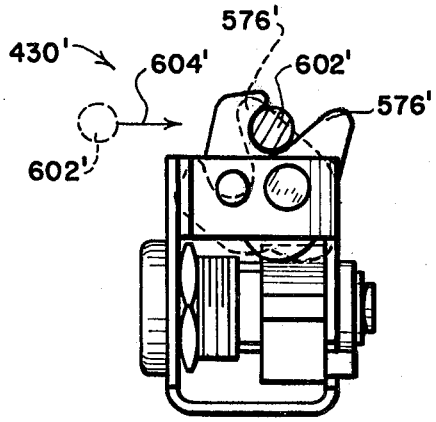
Figure 26:
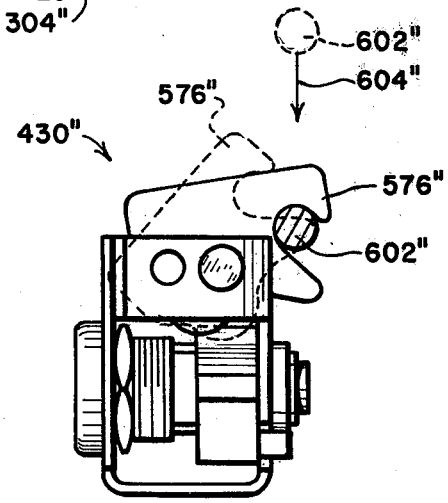

Referring to FIGS. 25 and 26, it will be readily apparent to those skilled in the art that modifications can be made in the arrangement and configuration of the latch bolt member 576 to provide alternate locking embodiments 430', 430'' adapted to receive keepers 602', 602'' which move relatively toward the lock embodiments 430', 430'' from directions different than that illustrated in FIG. 21, as indicated by the arrows 604', 604''. In the lock embodiment of FIG. 25, the latch bolt member 576' is arranged to receive a keeper 602' which moves relatively toward the lock 430' from the left, as by the arrow 604'. In the lock embodiment of FIG. 26, the latch bolt member 576'' is arranged to receive a keeper 602'' which moves relatively toward the lock 430'' from above, as indicated by the arrow 604''.

As will be apparent from the foregoing description, the present invention provides a novel and improved, simple and rugged cabinet lock arrangement wherein a highly versatile housing may be used with a number of different types of actuator mechanisms and latch bolt mechanisms. The universal nature of the lock construction which results from the preferred practice of the present invention provides significant improvements and advantages over prior proposals.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exist in the invention disclosed.

What is claimed is:

1. A cabinet lock, comprising:

(a) a one-piece housing having front and back walls extending in spaced, substantially parallel planes, the front and back walls having overlying first and second ends, the front and back walls being interconnected near their first ends by an end wall, and being interconnected near their second ends by a pair of side walls, the side walls extending in spaced parallel planes which substantially orthogonally intersect the planes of the front and back walls, the front and back walls having a first set of aligned holes formed therethrough, the side walls having a second set of aligned holes formed therethrough;

(b) actuator means extending into the first set of holes and being supported by the front and back walls;
(c) rotary latch bolt means extending into the second set of holes and being supported by the side walls;
(d) the actuator means including:
(i) a cam member mounted for movement between locked and unlocked positions; and,
(ii) first biasing means biasing the cam member toward its locked position;
(e) the rotary latch bolt means including:
(i) a latch bolt member mounted for rotary movement about the axis of the second set of holes between latched and unlatched positions; and,
(ii) second biasing means biasing the latch bolt member toward its unlatched position;
(f) the cam member and the latch bolt member having interengaging surface means formed thereon for:
(i) permitting the cam member to move, under the influence of the first biasing means, to its locked position when the latch bolt member is moved, in opposition to the action of the second biasing means, from its unlatched position to its latched position; and
(ii) retaining the latch bolt member in its latched position until the cam member is moved, in opposition to the action of the first biasing means, to its unlocked position.

2. The cabinet lock of claim 1 wherein:
(a) at least one of the front and back walls has a slot formed therein near its second end and extending in a plane which parallels the planes of the side walls at a location intermediate the planes of the side walls; and
(b) the latch bolt member being operative to extend through the slot when in at least one of its latched and unlatched positions.

3. The cabinet lock of claim 1 wherein:
(a) the end and side walls are elongate with their lengths extending in directions transverse to the planes of the front and back walls; and,
(b) the first set of holes has an axis which extends in the plane of the slot and which parallels the lengths of the end and side walls.

4. The cabinet lock of claim 1 wherein:
(a) the end wall is formed integrally with the front and back walls; and,
(b) the side walls are formed integrally with only one of the front and back walls and are welded to the other of the front and back walls.

5. The cabinet lock of claim 4 wherein the side walls are formed integrally with the back wall, and each of the side walls has an outwardly turned foot portion which engages and is welded to the back face of the front wall.

6. The cabinet lock of claim 1 wherein a third set of aligned holes is formed through the side walls at a location spaced from the second set, the third set having an axis which parallels the axis of the second set and which provides an alternate mounting location for the latch bolt means.

7. The cabinet lock of claim 1 wherein the actuator means include an actuator member extending through the front wall hole for moving the cam member between its locked and unlocked positions.

8. The cabinet lock of claim 1 wherein the actuator means includes an actuator member journaled for rotary movement about the axis of the first set of holes for moving the cam member between its locked and unlocked position.

9. The cabinet lock of claim 8 wherein the actuator member includes a key operated lock cylinder adapted to move the cam member from its locked position to its unlocked position when a key is turned in the lock cylinder.

10. The cabinet lock of claim 1 wherein the actuator means includes an actuator member movable along the axis of the first set of holes for moving the cam member between its locked and unlocked positions.

11. The cabinet lock of claim 10 wherein the actuator member extends through the front wall hole and includes a push button.

12. The cabinet lock of claim 10 wherein the actuator member extends through the front wall hole and includes a pull-type knob.

13. The cabinet lock of claim 1 wherein the first biasing means includes a torsion coil spring interposed between one of the side walls and the cam member.

14. The cabinet lock of claim 1 wherein the first biasing means includes a helically wound torsion spring interposed between the back wall and the cam member.

15. The cabinet lock of claim 1 wherein the first biasing means includes a compression coil spring interposed between the back wall and the cam member.

16. The cabinet lock of claim 1 wherein the second biasing means includes a torsion coil spring interposed between one of the side walls and the latch bolt member.

17. The cabinet lock of claim 1 wherein:
(a) the latch bolt member is mounted for rotation about the axis of the second set of holes and rotates in a first direction of rotation in moving from its unlatched position to its latched position;
(b) the first biasing means is operative to bias the cam member in a given direction away from its unlocked position toward its locked position;
(c) the first biasing means is operative to continue to bias the cam member in said given direction even after the cam member is in its locked position; and,
(d) the cam member is provided with a surface portion which, when the cam member is in its locked position, engages the latch bolt member and, by virtue of the continued biasing action of the first biasing means, causes the latch bolt member to be biased in said first direction toward a more tightly latched position.

18. A cabinet lock comprising:
(a) a housing having overlying front and back walls interconnected by an end wall and by a pair of spaced side walls, the front and back walls having a first set of aligned mounting formations provided thereon, the side walls having a second set of aligned mounting formations provided thereon;
(b) actuator means supported by the first set of mounting formations;
(c) rotary latch bolt means supported by the second set of mounting formations;
(d) the actuator means including:
(i) a cam member mounted for movement between locked and unlocked positions; and,
(ii) first biasing means biasing the cam member toward its locked position;
(e) the rotary latch bolt means including:
(i) a latch bolt member mounted for rotary movement between latched and unlatched positions; and, (ii) second biasing means biasing the latch bolt member toward its unlatched position; and, (f) the cam member and the latch bolt member having interengaging surface means formed thereon for:

(i) permitting the cam member to move, under the influence of the first biasing means, to its locked position when the latch bolt member is moved, in opposition to the action of the second biasing means, from its unlatched position to its latched position; and, (ii) retaining the latch bolt member in its latched position until the cam member is moved, in opposition to the action of the first biasing means, to its unlocked position.

19. The cabinet lock of claim 18 wherein the housing is formed in one piece with the front, back, end and side walls formed integrally.

20. The cabinet lock of claim 18 wherein the housing is formed as a stamping with the end wall extending integrally between the front and back walls and the side walls extending integrally from the back wall and being spot welded to the front wall.

21. The cabinet lock of claim 18 additionally including a third set of aligned mounting formations provided on the side walls at a location spaced from the second set to provide an alternate mounting location for the latch bolt means.

22. The cabinet lock of claim 18 wherein the first set of mounting formations includes a hole formed through the front wall.

23. The cabinet lock of claim 22 wherein the actuator means include an actuator member extending through the front wall hole for moving the cam member between its locked and unlocked positions.

24. The cabinet lock of claim 22 wherein the actuator means includes a rotary actuator member journaled in the front wall hole.

25. The cabinet lock of claim 22 wherein the actuator means includes a key-operated lock cylinder mounted in the front wall hole.

26. The cabinet lock of claim 22 wherein the actuator means includes an actuator member movable axially through the front wall hole to move the cam member between its locked and unlocked positions.

27. The cabinet lock of claim 18 wherein the first biasing means includes a torsion coil spring interposed between one of the side walls and the cam member.

28. The cabinet lock of claim 18 wherein the first biasing means includes a helically wound torsion spring interposed between the back wall and the cam member.

29. The cabinet lock of claim 18 wherein the first biasing means includes a compression coil spring interposed between the back wall and the cam member.

30. The cabinet lock of claim 18 wherein the second biasing means includes a torsion coil spring interposed between one of the side walls and the latch bolt member.

* * * * *